US006042345A

United States Patent [19]

Bishop et al.

[11] Patent Number: 6,042,345

[45] **Date of Patent: *Mar. 28, 2000**

[54] PIEZOELECTRICALLY ACTUATED FLUID PUMPS

[75] Inventors: Richard P Bishop, Fairfax Station; Bradbury R. Face, Smithfield; Samuel A. Face; Stephen E Clark, both of Norfolk; Norvell S. Rose, Virginia Beach, all of Va.

[73] Assignee: Face International Corporation, Norfolk, Va.

[ * ] Notice: This patent is subject to a terminal disclaimer.

[21] Appl. No.: 09/055,000

[22] Filed: Apr. 3, 1998

Related U.S. Application Data

[63] Continuation-in-part of application No. 08/843,380, Apr. 15, 1997, Pat. No. 5,816,780.

[51] Int. Cl.[7] ..... F04B 17/00

[52] U.S. Cl. ..... 417/322; 417/413.2

[58] Field of Search ..... 417/322, 327, 417/413.2, 488

[56] References Cited

U.S. PATENT DOCUMENTS 5,816,780 10/1998 Bishop et al. ..... 417/322

*Primary Examiner*—Teresa Walberg
*Assistant Examiner*—Vinod D Patel
*Attorney, Agent, or Firm*—Stephen E. Clark

[57] ABSTRACT

A piezoelectrically actuated fluid pump including a pump housing, a pump chamber, inlet and outlet ports for communicating the pump chamber with the exterior of the pump housing, valving means for opening and closing the ports, two pre-stressed piezoelectric diaphragm members which are self-actuated, and energizing means is provided. The diaphragm members include a prestressed piezoelectric element which is durable, inexpensive and lightweight as compared with diaphragm members of prior diaphragm pumps of comparable discharge capacity, and is actuated via electrical signals from an outside power source. No exterior mechanical means for driving the diaphragm members is necessary. A modification is disclosed in which a central computer independently controls the phase angle of oscillation of the two diaphragm members, providing precise flow rate control.

9 Claims, 12 Drawing Sheets

PIEZOELECTRICALLY ACTUATED FLUID PUMPS

This is a continuation-in-part of Ser. No. 08/843,380 filed Apr. 15, 1997 now U.S. Pat. No. 5,816,780.

BACKGROUND OF THE INVENTION

1. Field of Invention

The present invention relates to fluid pumps. More particularly, the present invention relates to diaphragm and piston pumps wherein the pump chamber working volume varies due to deformation and/or displacement of a diaphragm or piston member, and wherein the diaphragm or piston member either comprises or is acted upon by a piezoelectric element which deforms when electrically energized.

2. Description of the Prior Art

Diaphragm pumps are a very well known form of positive displacement reciprocating pump. Diaphragm pumps typically comprise a pump chamber, an inlet valve which opens the chamber to an inlet pipe during the suction stroke, an outlet valve, which opens to a discharge pipe during the discharge stroke, and a diaphragm drive mechanism. The pumping action is developed through the alternating filling and emptying of the pump chamber caused by the reciprocating motion of the diaphragm member which varies the confining work volume of the pump chamber.

In prior diaphragm pumps the reciprocating motion of the diaphragm member is typically accomplished by attaching the diaphragm member to a connecting rod which in turn is connected to a rotating crank, or by an equivalent mechanical transmission system. The power to the rotating crank is typically provided by internal combustion-driven piston(s), by steam-driven piston(s), by electric motor, or by equivalent mechanisms.

A problem associated with such prior diaphragm pumps is that, owing in part to the complex nature of the connecting rod, the rotating crank and the mechanical power source, they are relatively heavy.

Another problem associated with such prior diaphragm pumps is that, owing in part to the complex nature of the connecting rod, the rotating crank and the mechanical power source, they are relatively expensive.

Another problem associated with such prior diaphragm pumps is that, owing in part to the complex nature of the connecting rod, the rotating crank and the mechanical power source, they have numerous components which are susceptible to wearing out, and are relatively costly to maintain.

Another problem associated with such prior diaphragm pumps is that, owing in part to the complex nature of the connecting rod, the rotating crank and the mechanical power source, is that they are of relatively low power conversion efficiency.

Another problem associated with such prior diaphragm pumps is that, owing in part to the nature of the connecting rod, the rotating crank and the mechanical power source, is that the discharge pressure and flow rate are not readily adjustable and are not independently controllable.

Another problem associated with such prior diaphragm pumps is that the mechanical power source which drives the diaphragm member is, in most embodiments, not immersible in liquids, particularly in volatile liquids.

Another problem associated with many such prior diaphragm pumps is that in order to stop discharge the pump must be (electrically or mechanically) disconnected from its power supply.

Another problem associated with many such prior diaphragm pumps is that, owing in part to the complex nature and relative inefficient energy conversion properties of the connecting rod, the rotating crank and the mechanical power source, they have a tendency to overheat unless provided with supplemental heat sinking materials.

Another problem associated with such prior diaphragm pumps is that they are frequently difficult to prime.

Another problem associated with such prior diaphragm pumps is that fluid is discharged in discontinuous spurts, the volume and frequency of which spurts, is typically non-adjustable and dependent upon the nature of the driving power supply.

Another problem associated with prior diaphragm pumps is that the controlled expansion and contraction of the volume of the pump chamber, the controlled valving of the fluid inlet, and the controlled valving of the fluid outlet are accomplished by at least three separate components of the device, each of which is dedicated to the performance of its singular task. Accordingly, such prior devices have multiple parts which are susceptible to wearing out, and which require maintenance, and which increase the cost of the device. In addition, the movement of these various components must be controlled so as to ensure the proper sequencing of their operations. While the proper timing/sequencing of operation of the inlet valve, the outlet valve, and the diaphragm member are readily controlled during relatively low frequency operation, at extremely high frequency pumping operations it is more difficult to ensure the proper sequencing of the three mentioned components.

SUMMARY OF THE INVENTION

Accordingly, it is a primary object of the present invention to provide a diaphragm pump in which the diaphragm member is self-actuated, (that is: which moves in response to electrical signals provided to it from an outside source), and which does not require external mechanical power to be transmitted to the diaphragm member in order to effect the movement of the diaphragm member.

It is another object of the present invention to provide a device of the character described which is relatively light weight, as compared with prior diaphragm pumps of comparable discharge capacity.

It is another object of the present invention to provide a device of the character described that is relatively inexpensive, as compared with prior diaphragm pumps of comparable discharge capacity.

It is another object of the present invention to provide a device of the character described that is relatively easy and inexpensive to maintain, and which has relatively few parts which are susceptible to wearing out, as compared with prior diaphragm pumps of comparable discharge capacity.

It is another object of the present invention to provide a device of the character described that is of relatively high power conversion efficiency, as compared with prior diaphragm pumps of comparable discharge capacity.

It is another object of the present invention to provide a device of the character described in which the discharge pressure and flow rate are readily adjustable and are independently controllable.

It is another object of the present invention to provide a device of the character described that is immersible in liquids, including volatile liquids.

It is another object of the present invention to provide a device of the character described in which discharge from the pump can be accomplished without disconnecting the diaphragm member from the power supply.

It is another object of the present invention to provide a device of the character described which does not readily overheat, which does not require supplemental heat sinking materials, and in which the fluid medium to be pumped may serve as a heat sink.

It is another object of the present invention to provide a device of the character described that is easily primed or is self priming.

It is another object of the present invention to provide a device of the character described in which volume and frequency fluid discharge is highly variable and controllable, and which discharge is not dependent upon the nature of a supplemental mechanical power supply.

It is another object to provide a modification of the present invention in which the diaphragm member serves as a component of the inlet valve and/or the outlet valve.

Further objects and advantages of the invention will become apparent from a consideration of the drawings and ensuing description thereof.

DESCRIPTION OF THE PREFERRED EMBODIMENT

Figure 1:
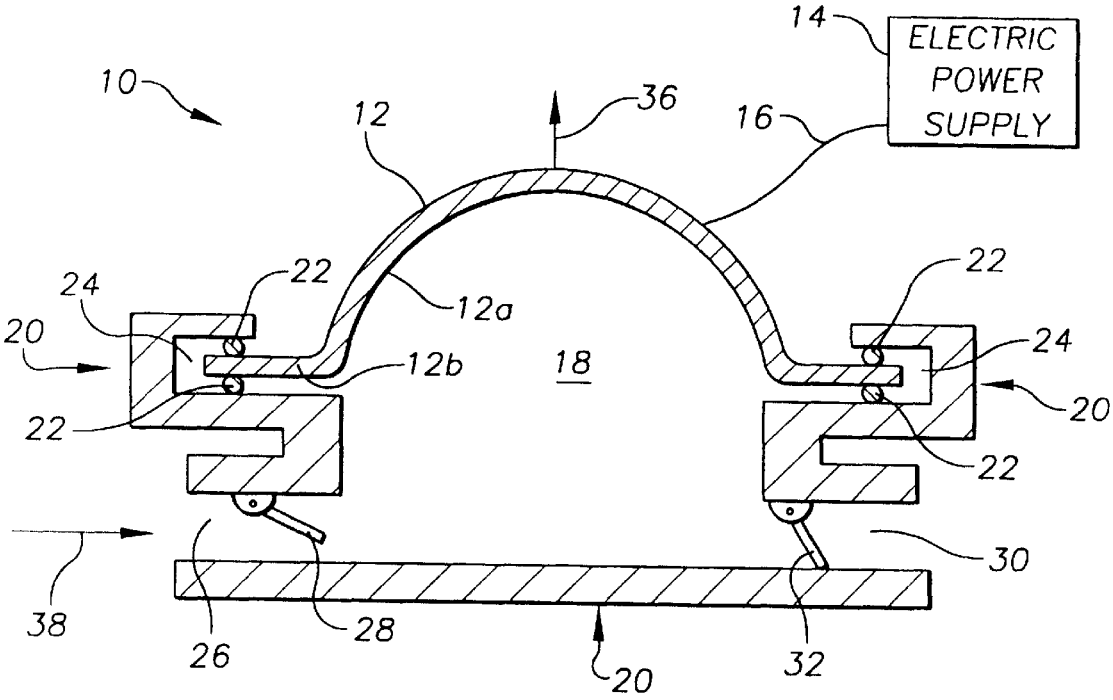
FIG. 1 is a medial cross-sectional elevation view showing a single-diaphragm pump constructed in accordance with the present invention with the diaphragm member in the expansion stroke.
Figure 2:
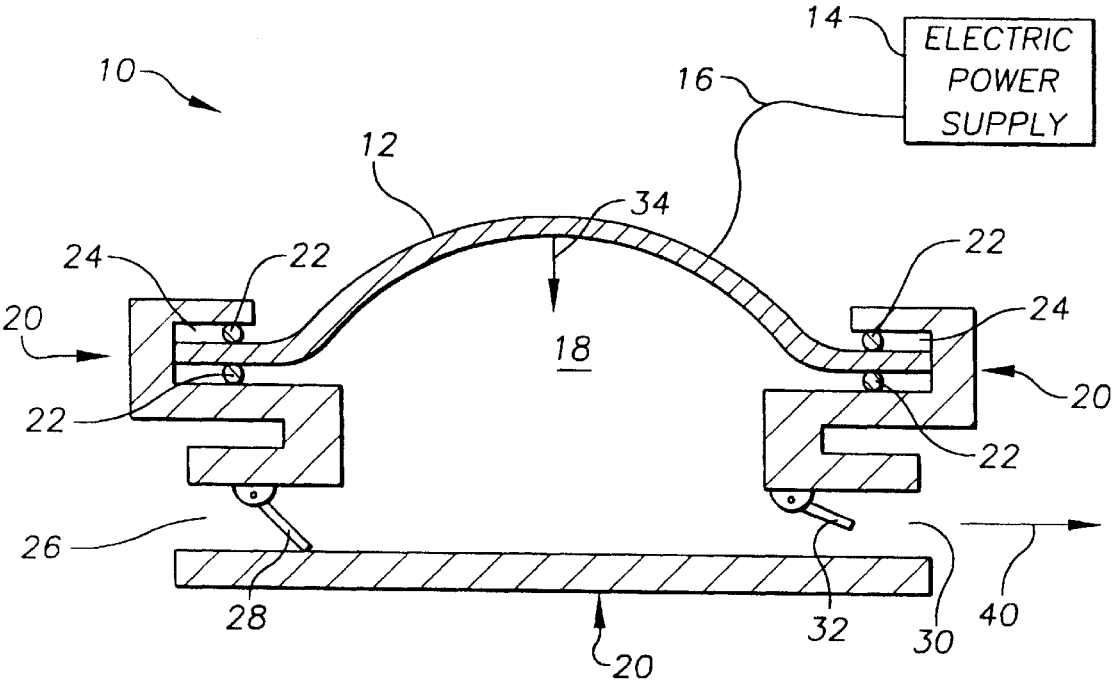
FIG. 2 is a medial cross-sectional elevation view showing a single-diaphragm pump constructed in accordance with the present invention, with the diaphragm member in the compression stroke.

Referring now to FIG. 1 and FIG. 2: A pump housing (generally designated 20 in the figures) and a diaphragm 12 surround a pump chamber 18 of a single-diaphragm pump device (generally designated 10 in the figures). The pump chamber 18 is adapted to receive a fluid, principally liquid, through an inlet 26. Fluid is discharged from the pump chamber 18 through an outlet 30. The pump chamber 18 is sealed from the outside of the pump device 10 except through the inlet 26 and the outlet 30. Check valves 28 and 32 are provided in the inlet 26 and the outlet 28, respectively, to prevent fluid flow out of the pump chamber via the inlet 26 or into the pump chamber 18 via the outlet 30.

The diaphragm member 12 is a piezoelectric transducer having two opposing major faces which, in the preferred embodiment of the invention, is in the form of a thin walled dome as illustrated in FIG. 1. The diaphragm member 12 has a normally concave portion 12*a* adjacent the pump chamber 18. A recess 24 is provided in the pump housing 20 to receive and capture the lip 12*b* of the diaphragm member 12. A pair of continuous O-rings 22, or equivalent means, provide a water-tight seal between the lip 12*b* of the diaphragm member and the housing 20. The O-ring seals 22 maintain a water-tight seal while allowing for radial displacement of the diaphragm lip 12*b* within the recess 24. Ample space is provided in the recess 24 between the lip 12*b* and the housing 20 to allow for radial displacement of the lip 12*b* which may occur due to the axial motion of the normally concave portion 12*a* of the diaphragm. As used herein, axial motion of the concave portion 12*a* of the diaphragm refers to motion which is substantially perpendicular to the thin-walled concave portion 12 of the diaphragm member 12. Thus outward axial motion of the normally concave portion 12*b* of the diaphragm member, as indicated in FIG. 1 by arrow 36, increases the effective volume of the pump chamber 18; and inward axial motion of the normally concave portion 12*b* of the diaphragm member, as indicated in FIG. 2 by arrow 34, decreases the effective volume of the pump chamber 18. As used herein, radial movement of the lip 12*b* of the diaphragm member refers to movement at or near the periphery of the diaphragm member 12 which is in a direction substantially perpendicular to the direction of axial movement as defined hereinabove.

The diaphragm member 12 is in communication with an electric power supply 14 via electric conductor 16. The diaphragm member 12, being constructed of a thin-walled piezoelectric material, deforms when subjected to an electric field. In the preferred embodiment of the invention, the diaphragm member 12 has a thin-walled, normally concave portion 12*a* which, when subjected an electric field, primarily deforms in the axial direction (i.e. as indicated in FIG. 2 by arrow 34).

In operation the electric power supply 14 sends (via conductor 16) to the diaphragm member 12 an alternating current which causes the normally concave portion 12*b* of the diaphragm member to axially extend and contract (as indicated by arrows 34 and 36) which effectively increases and decreases, respectively, the working volume of the pump chamber 18, and which reduces and increases, respectively, the hydraulic pressure inside of the pump chamber 18, which respectively draws fluid into (arrow 38) the pump chamber and forces fluid out of (arrow 40) the pump chamber. Check valves 28 and 32 open and close in accordance with the hydraulic pressure inside of the pump chamber 18 to permit only one-way flow of the pumped fluid.

In the preferred embodiment of the invention the diaphragm member 12 is a "unimorph" piezoelectric element. That is, when energized by an electric field it deforms substantially more in one direction (i.e. axially) than in any other direction (i.e. radially). Unimorph piezoelectric elements are preferred for use in the present invention because the pumping pressure developed by movement of the diaphragm member 12 is the result of its deformation perpendicular to the thin wall of the piezoelectric element (i.e. axially), whereas little or no useful pumping pressure is developed by radial motion of the lip 12*b* of the diaphragm. However, it is within the scope of the present invention to use a diaphragm member 12 constructed of any thin wall, piezoelectric element which is either normally curved or which becomes curved when subjected to an electric field.

It will be understood that a single-diaphragm pump 10 constructed in accordance with the foregoing disclosure provides a pump device in which the diaphragm member 12 is self-actuated, (that is: which moves in direct response to electrical signals provided to it from the electric power supply 14), and which does not require external mechanical power to be transmitted to the diaphragm member 12 in order to effect its movement.

It will be also understood that a single-diaphragm pump 10 constructed in accordance with the foregoing disclosure provides a pump device which is relatively light weight, (as compared with prior diaphragm pumps of comparable discharge capacity), because the only moving part is thin-walled diaphragm member 12, and because there are no ancillary mechanical power transmission components to drive the diaphragm member 12.

It will be also understood that a single-diaphragm pump 10 constructed in accordance with the foregoing disclosure provides a pump device that is relatively inexpensive, as compared with prior diaphragm pumps of comparable discharge capacity, because it has relatively few parts and requires no ancillary mechanical power transmission components to drive the diaphragm member 12.

It will be also understood that a single-diaphragm pump 10 constructed in accordance with the foregoing disclosure provides a pump device that is relatively easy and inexpensive to maintain, and which has relatively few parts which are susceptible to wearing out, as compared with prior diaphragm pumps of comparable discharge capacity.

It will be also understood that a single-diaphragm pump 10 constructed in accordance with the foregoing disclosure provides a pump device that is of relatively high power conversion efficiency, as compared with prior diaphragm pumps of comparable discharge capacity, because all of the (electrical) power used by the device is applied directly to the diaphragm member 12 itself, and there are no energy losses related to ancillary mechanical power transmission components (as no such components are required in the present invention to drive the diaphragm member 12).

The discharge flow rate from the pump chamber 18 of a single-diaphragm pump device 10 constructed in accordance with the present invention may be varied by simply varying the frequency of the electrical signal supplied to the diaphragm member 12 from the electric power supply 14. Thus, it is desirable that the electric power supply 14 comprise standard frequency adjustment circuitry. It will be understood that (under normal conditions) the diaphragm member 12 will axially oscillate at a frequency corresponding to the frequency of the input electric signal supplied to the diaphragm member by the electric power supply.

Figure 3:
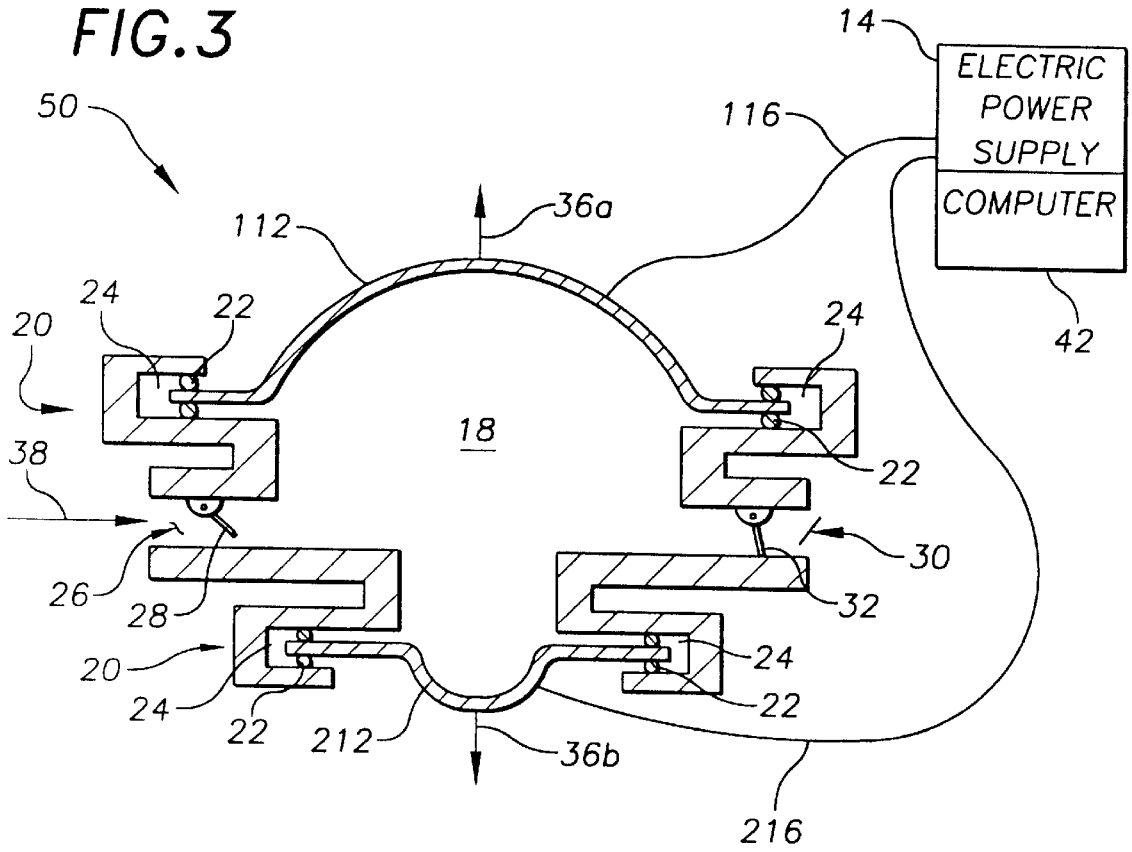
FIG. 3 is a medial cross-sectional elevation view showing a multiple-diaphragm pump constructed in accordance with the present invention with the diaphragm members in the expansion stroke.
Figure 4:
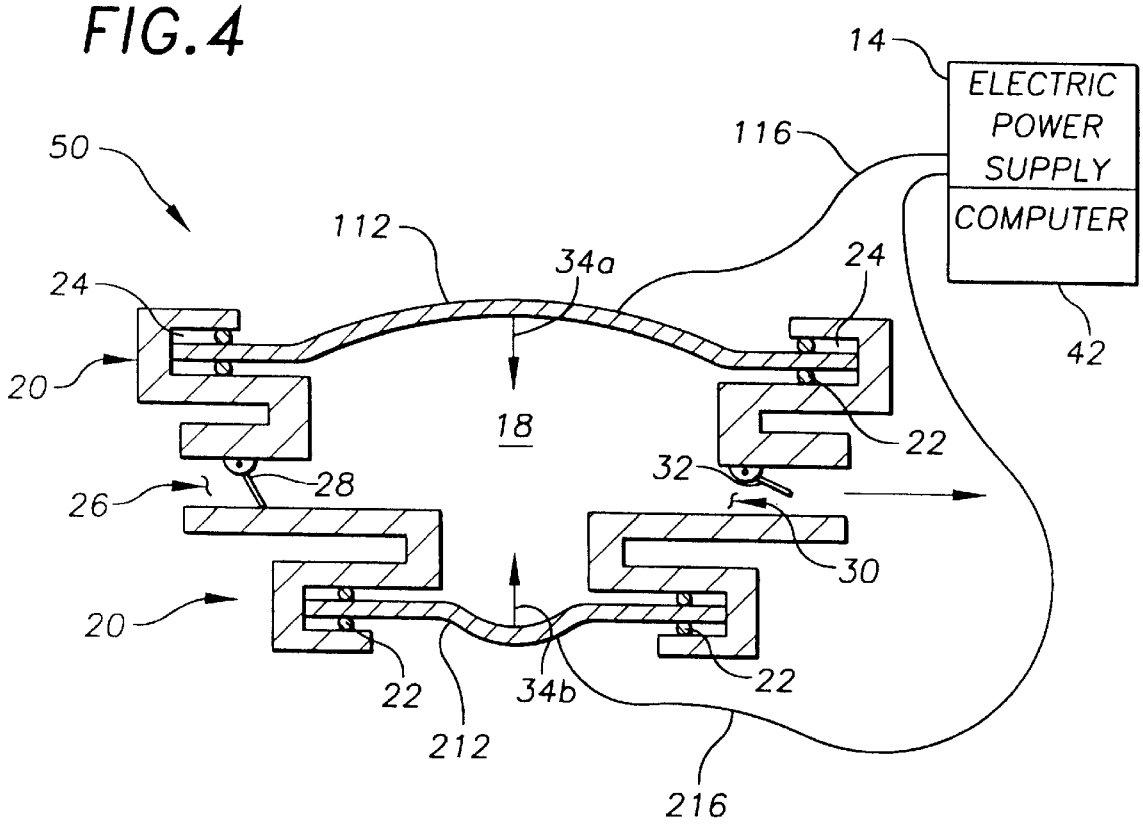
FIG. 4 is a medial cross-sectional elevation view showing a multiple-diaphragm pump constructed in accordance with the present invention with the diaphragm members in the compression stroke.

Referring now to FIG. 3 and FIG. 4: FIGS. 3 and 4 illustrate a multiple-diaphragm pump (generally designated 50). For the sake of clarity the following disclosure describes the construction and operation of a multiple-diaphragm pump having two diaphragm members (112 and 212), but, as will become apparent from the following disclosures, modified pumps using any number of diaphragm members may be similarly constructed and operated in accordance with the present invention.

In the multiple diaphragm pump 50 illustrated in FIG. 3 and FIG. 4 a first diaphragm member 112 and a second diaphragm member 212 are each attached in a sealed fashion to the pump housing 20 in a manner similar to that described above with respect to the preferred embodiment of the invention. A computer 42 is in communication with an electric power supply 14 which sends electric current to the first diaphragm member 112 and the second diaphragm member 212 via electric conductors 116 and 216, respectively. The first diaphragm member 112 and the second diaphragm member 212 each preferably comprise thin-walled unimorph piezoelectric elements, such that each axially deforms (eg. as indicated at arrows 34*a* and 34*b*) when subjected to an electric field. Under normal conditions, each diaphragm member (eg. 112 and 212) axially oscillates at a frequency corresponding to the frequency of the electric current applied to it from the electric power supply via its respective electric conductor (116 or 216).

FIG. 3 illustrates the condition wherein each diaphragm member (112 and 212) is simultaneously axially extended (as indicated by arrows 36*a* and 36*b*) so as to effectively increase the volume of the pump chamber 18, thereby reducing the hydraulic pressure within the pump chamber 18, thus drawing fluid into the pump chamber 18 through the inlet 26. Check valve 32 prevents fluid from being drawn into the pump chamber 18 through the outlet 30. FIG. 4 illustrates the condition wherein each diaphragm member (112 and 212) is simultaneously axially contracted (as indicated by arrows 34*a* and 34*b*) so as to effectively decrease the volume of the pump chamber 18, increasing the hydraulic pressure within the pump chamber 18, and thus discharging fluid from the pump chamber 18 through the outlet 30. Check valve 28 prevents fluid from being discharged from the pump chamber 18 through the inlet 26.

It will be understood that the volume of fluid that is drawn into the pump chamber 18 during the extension stroke (as indicated by arrow 36*a* and 36*b*), and the volume of fluid that is discharged from the pump chamber 18 during the compression stroke (as indicated by arrow 34*a* and 34*b*), equals the combined volume displaced by the two diaphragm members 112 and 212 between the two strokes, provided that the two diaphragm member 112 and 212 move together (i.e. the oscillations of the two diaphragm members are in phase).

If the frequency of oscillation of the first diaphragm member 112 is not in phase with the frequency of oscillation of the second diaphragm member 212, then the volume of fluid which is displaced from the pump chamber 18 during a given time period will equal the net positive volumetric displacement of the two diaphragm members 112 and 212 combined during that time period. It will be appreciated that by varying the oscillation phase angle between the first diaphragm member 112 and the second diaphragm member 212, the fluid discharge rate from the pump chamber 18 can be readily varied. For a dual-diaphragm pump constructed in accordance with the present invention, wherein the electric current to the two diaphragm members 112 and 212 are the same frequency, the maximum pump discharge rate will occur when the two diaphragm members 112 and 212 oscillate in phase; and the minimum pump discharge rate will occur when the two diaphragm members 112 and 212 oscillate 180 degrees out of phase. In the particular case of a dual-diaphragm pump in which the two diaphragm members 112 and 212 are of equal size, the pump discharge rate will be zero when the oscillations of the two diaphragm members are 180 degrees out of phase. It will be appreciated, therefore, that in a multi-diaphragm pump constructed in accordance with the present invention, the pump discharge rate can be readily adjusted from zero to a maximum simply by varying the phase angle of the electric output from the electric power supply 14. The phase angle of the electric output from the electric power supply 14 may be regulated by the computer 42.

Although it is within the scope of the present invention to construct a multiple-diaphragm pump device wherein each diaphragm member is of the same size, in certain applications it is desirable to construct multiple-diaphragm pump devices wherein the diaphragm members are of different sizes. FIGS. 3 and 4 illustrate a dual-diaphragm pump device 50 in which the first diaphragm member 112 is significantly larger than the second diaphragm member 212. In such a modification of the invention, during a single stroke of each of the two diaphragm members, the volume displaced by the (larger) first diaphragm member 112 will be significantly larger than the volume displaced by the (smaller) second diaphragm member 212; and the hydraulic forces against the (larger) first diaphragm member 112 will typically be substantially larger than the hydraulic forces against the (smaller) second diaphragm member.

An example of how a dual-diaphragm pump device having diaphragm members of significantly different size and having individually controlled frequencies of oscillation follows: In many diaphragm pump applications wherein the pump chamber 18 becomes dried out during periods of non-use, it is first necessary to "prime" the pump chamber before "normal" operation of the pump can commence. In the dual-diaphragm pump device 50 illustrated in FIG. 3, the (larger) first diaphragm member 112 may be advantageously actuated in order to prime an initially dry pump chamber 18. The computer 42 directs the electric power supply 14 to send electric current to the first diaphragm member 112 via the electric conductor 116. (The computer 42 may, at this time, direct the electric power supply 14 to send little or no electric current to the second diaphragm member 212, as the priming function is most efficiently accomplished by oscillation of the larger first diaphragm 112.) Although the first diaphragm member 112 displaces a large volume during each stroke, there is relatively little force against the diaphragm 112 when there is little or no liquid inside of the pump chamber 18 (i.e. when the pump chamber is un-primed). The computer may be programmed to vary the frequency of the electric current sent to the first diaphragm member 112 so that the frequency of the first diaphragm member is relatively high when the where there is little or no hydraulic back pressure (i.e. when the pump is completely dry), and then progressively decrease the frequency of the first diaphragm member 112 as the pump becomes "primed".

Once the pump chamber 18 is fully primed the computer 42 may advantageously direct the electric power supply 14 to send high frequency electric current to the (smaller) second diaphragm member 212. It will be appreciated that by oscillating a relatively small diaphragm at a relatively high frequency, the liquid discharge stream (i.e. via outlet 30) produced is relatively continuous and smooth (as contrasted, for example, with the discontinuous or "spurting" nature of a liquid stream which would typically be produced by a relatively lower frequency, high displacement volume diaphragm).

Figure 5:
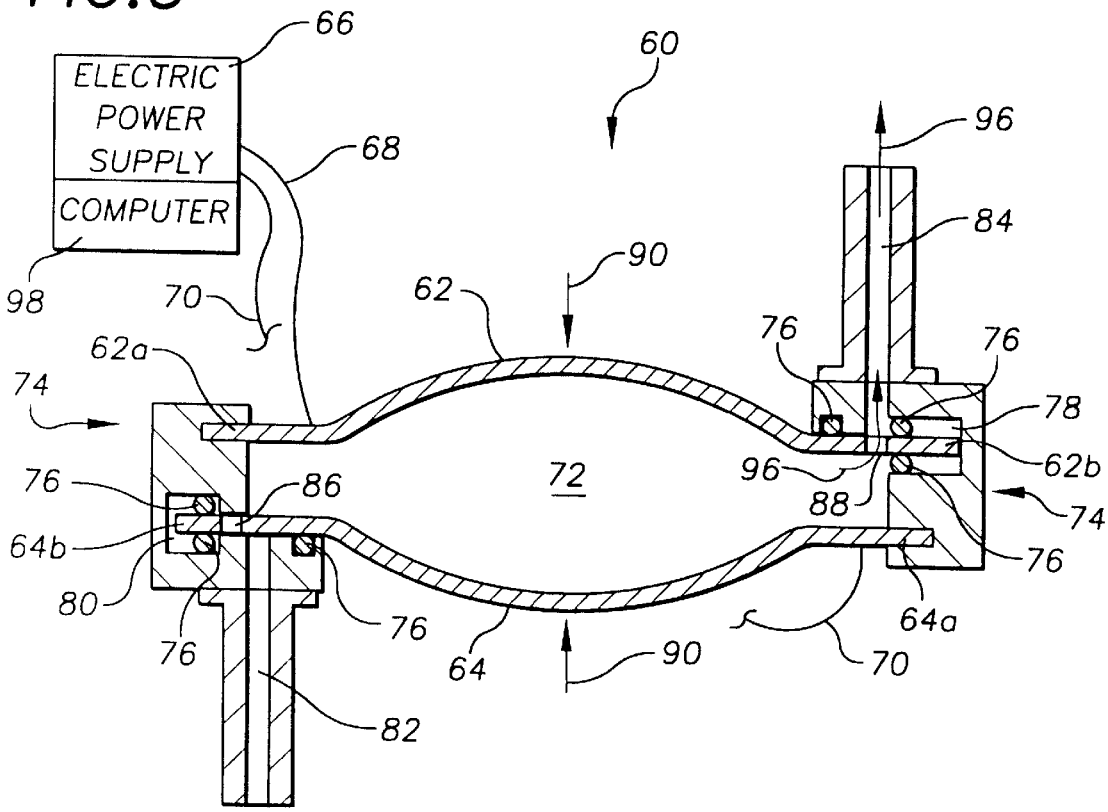
FIG. 5 is a medial cross-sectional elevation view showing a modified dual-diaphragm pump constructed in accordance with the present invention with the diaphragm members in the compressions stroke.
Figure 6:
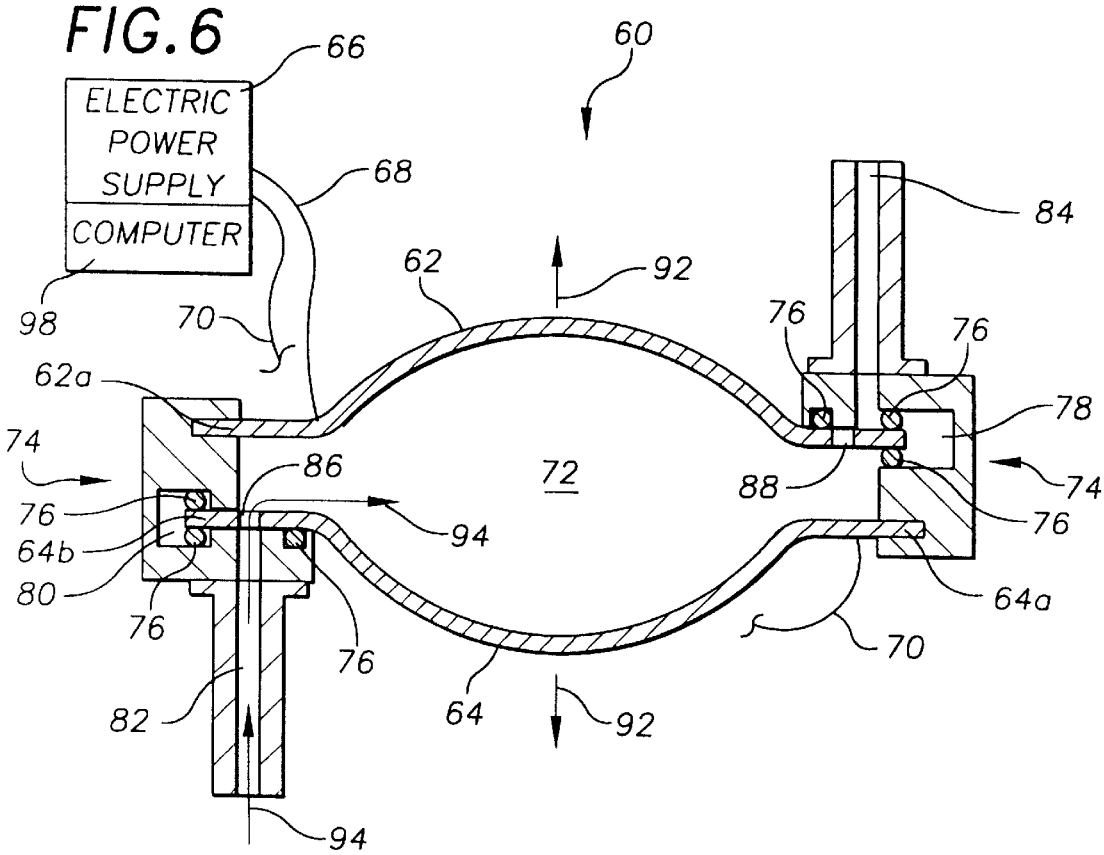
FIG. 6 is a medial cross-sectional elevation view showing a modified dual-diaphragm pump constructed in accordance with the present invention, with the diaphragm member in the compression stroke.

Referring now to FIGS. 5 and 6: In the multiple diaphragm pump 60 illustrated in FIG. 5 and FIG. 6 a first diaphragm member 62 and a second diaphragm member 64 are each attached in a sealed fashion to the pump housing 74 in a manner similar to that described above with respect to the preferred embodiment of the invention. A computer 98 is in communication with an electric power supply 66 which sends electric current to the first diaphragm member 62 and the second diaphragm member 64 via electric conductors 68 and 70, respectively. The first diaphragm member 62 and the second diaphragm member 64 each preferably comprise thin-walled piezoelectric elements, such that each axially deforms (eg. as indicated at arrows 90) when subjected to an electric field. Under normal conditions, each diaphragm member (eg. 62 and 64) axially oscillates at a frequency corresponding to the frequency of the electric current applied to it from the electric power supply via its respective electric conductor (68 or 70).

FIG. 6 illustrates the condition wherein each diaphragm member (62 and 64) is simultaneously axially extended (as indicated by arrows 92) so as to effectively increase the volume of the pump chamber 72, thereby reducing the hydraulic pressure within the pump chamber 72. The first diaphragm member 62 is securely attached at one side 62*a* to the pump housing 74. Its opposite side 62*b* is loosely held within a pump housing recess 78, within which it is permitted to move. Seals 76 are provided to prevent liquid within the pump chamber 72 from leaking out of the pump chamber 72. In a similar manner the second diaphragm 64 is securely attached at one side 64*a* to the pump housing, while its opposite side 64*b* is loosely held (albeit sealed 76) within a pump housing recess 80, within which it is permitted to move. As the first diaphragm member 62 extends due to electric excitation (as indicated by arrow 92), the loose end 62*b* of the diaphragm somewhat withdraws from the recess 78 such that a slotted opening 88 in the first diaphragm 62 becomes unaligned with the outlet 84 opening, thereby reducing or prohibiting fluid flow out of the pump chamber 72 via the outlet 84. As the second diaphragm member 64 extends due to electric excitation (as indicated by arrow 92), the loose end 64*b* of the diaphragm somewhat withdraws from the recess 80 such that a slotted opening 86 in the first diaphragm 62 becomes aligned with the inlet 84 opening thereby allowing fluid flow into the pump chamber 72 via the inlet 82 (caused by the reduced pump chamber 72 pressure occasioned by the extension of the two diaphragms).

It will be understood that, in a modified dual-diaphragm pump constructed in accordance with the above description and as schematically illustrated in FIGS. 5 and 6, each diaphragm member performs the dual functions of varying the effect pump chamber volume, and valving the pump chamber.

Figure 7:
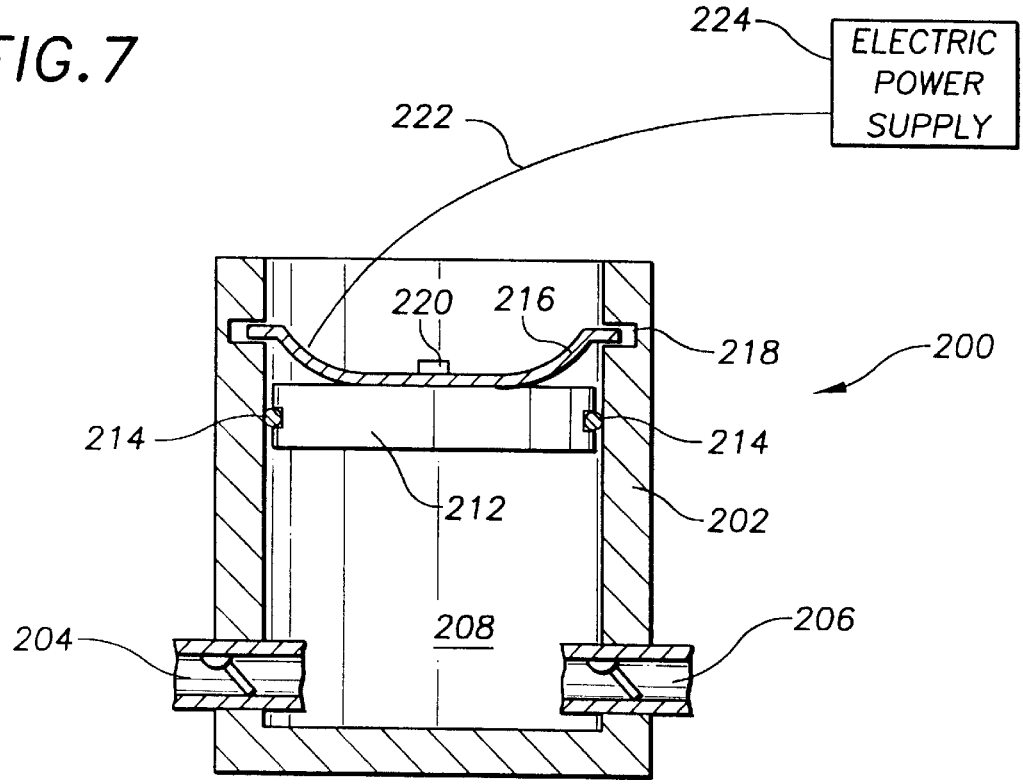
FIG. 7 is a medial cross-sectional elevation view showing a pump constructed in accordance with a modification the present invention, with the piezoelectric actuator acting against a piston member.

Referring now to FIG. 7: FIG. 7 illustrates a pump (generally designated 200) having a pump housing 202, an inlet 204, an outlet 206, an interior pump chamber 208, and check valves 210. The working volume of the pump chamber 208 varies depending upon the positioning of a moveable piston member 212. The piston member is provided with a piston ring, O-ring, or equivalent seal 214. Although a moveable piston member 212 is described for use in this embodiment of the invention, it will be appreciated from an understanding of the present disclosure that the piston member 212 could alternatively be replaced by a flexible diaphragm member or equivalent component. A convex face of a curvilinear piezoelectric actuator member 216 is secured at its periphery to the pump housing 202. As illustrated in FIG. 7, the piezoelectric actuator member 216 may be held in place by engagement a recess 218 in the pump housing 202 (or by equivalent means), to restrict axial displacement of the periphery of the piezoelectric actuator member 216. The piezoelectric actuator member 216 is operationally in contact with the piston member 212, such that when the actuator member 216 axially deforms it axially displaces the piston member 212 by an equivalent dimension in the same direction. In order to cause the piston member 212 to move together with the convex face of the piezoelectric actuator member 216, a fastener 220 may be used to secure the actuator member 216 to the piston member 212. Alternatively, a compression spring (not shown), or the like, may be positioned within the pump chamber 208 and in contact with piston member 212, so as to hold the piston member against the convex face of the piezoelectric actuator member 216. The piezoelectric actuator member 216 is electrically coupled (via conductor 222) to an electric power supply 224. In operation, fluid is drawn into the pump chamber 208 through the inlet 204 by retraction of the piston member 212 and subsequently pushed out of the pump chamber 208 through the outlet 206 by extension of the piston member 212, corresponding to axial deformation of the piezoelectric actuator member 216 in accordance with the electrical signal communicated to it from the electric power supply 224.

Figure 8:
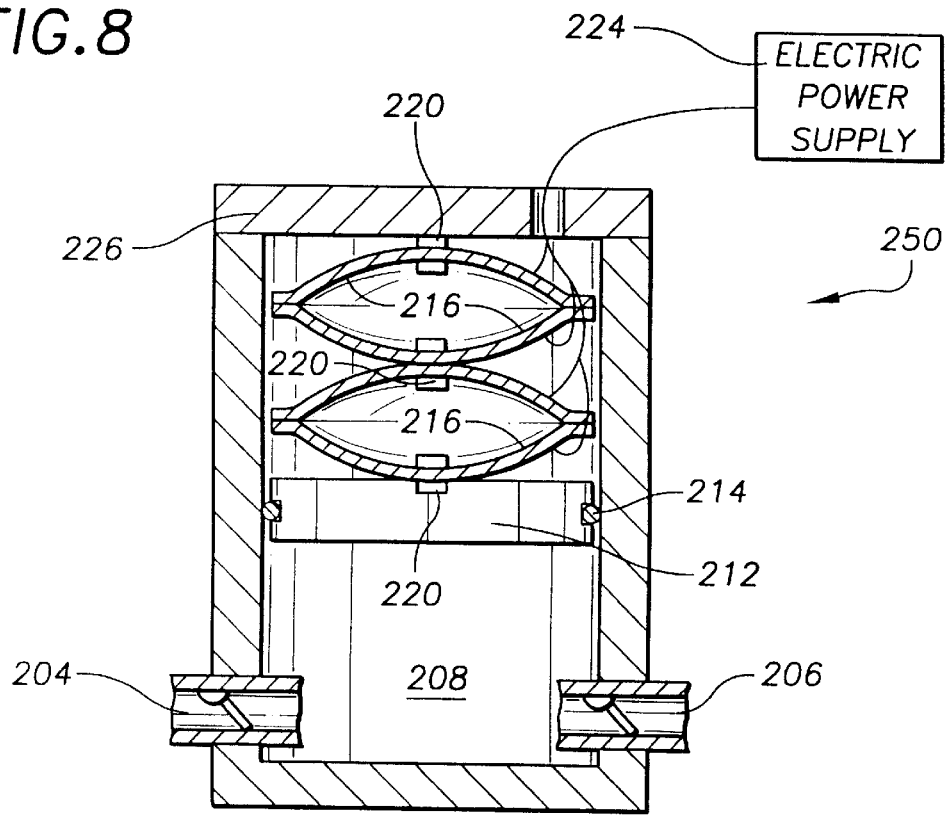
FIG. 8 is a medial cross-sectional elevation view showing a pump constructed similarly to that shown in FIG. 7, except with multiple actuator members.

Referring now to FIG. 8: FIG. 8 illustrates a pump which is constructed and operates substantially like the pump shown in FIG. 7 wherein like indicia refer to like components, except in the pump of FIG. 8 a series of curvilinear piezoelectric actuator members 216 are arranged convex face-to-convex face and concave face-to-concave face, such that the net axial displacement imparted by the actuator members 216 to the piston member 208 equals the sum of the axial deformations of the individual actuator members 216. Fasteners 220 may be used to secure the convex faces of adjacent actuator members 216 and to secure the outboard-most actuator members to the top 226 of the pump housing and the piston member 212, respectively. It will be understood that any number of similarly arranged actuator members 216 may be coupled together so as to produce the desired pump displacement/output.

Figure 9:
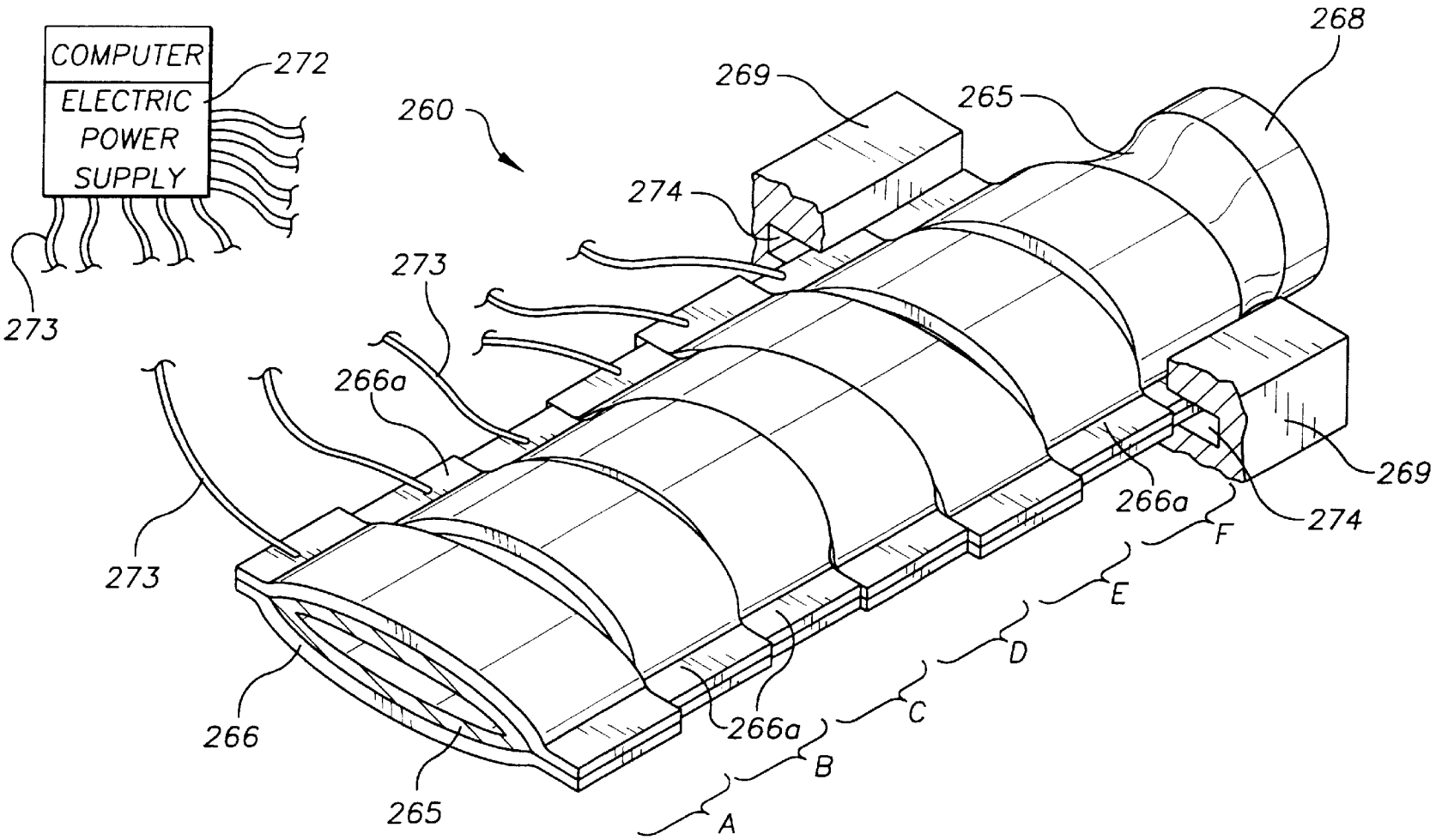
FIG. 9 is a perspective view showing a piezoelectrically actuated peristaltic pump.
Figure 10:
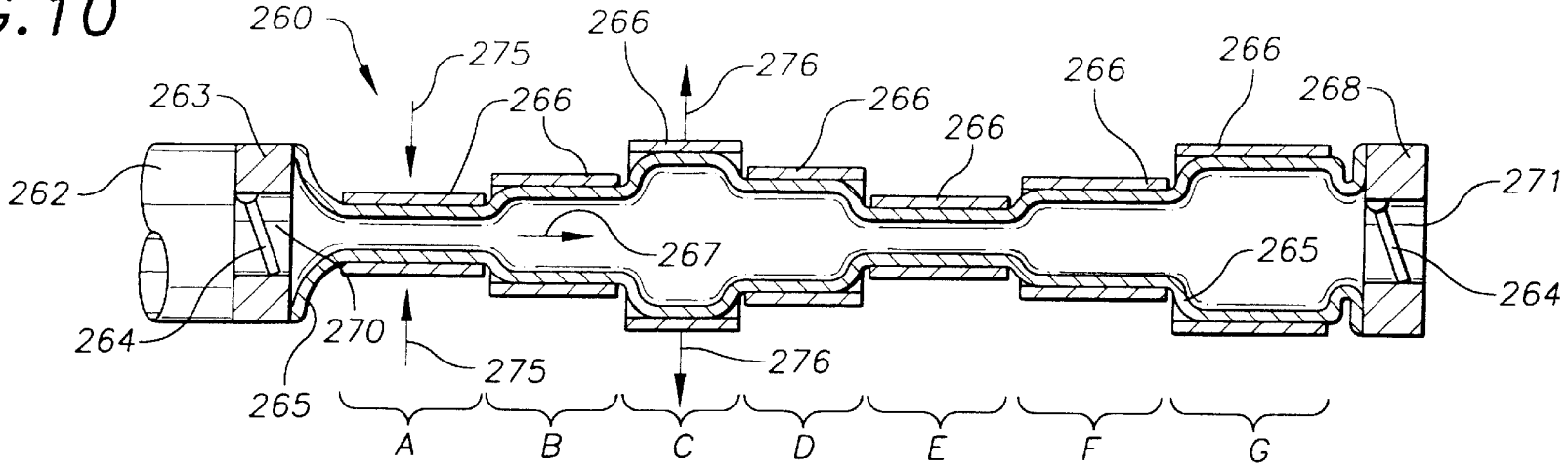
FIG. 10 is a medial cross-sectional view of a piezoelectrically actuated peristaltic pump.
Figure 11:
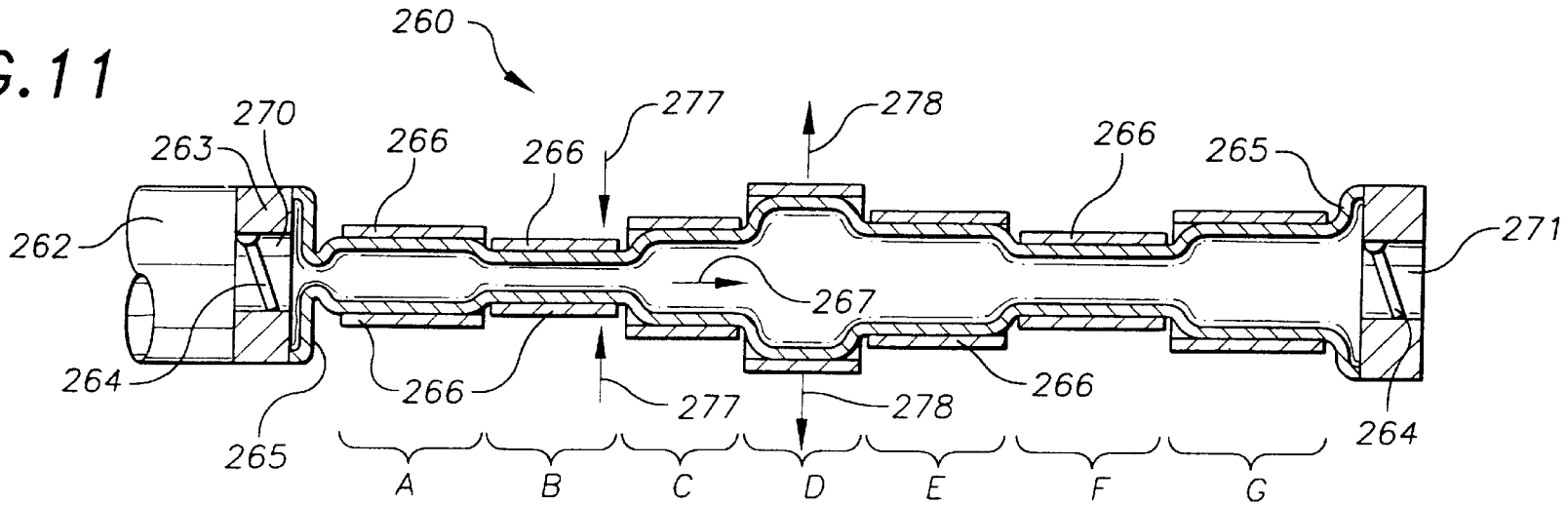
FIG. 11 is a medial cross-sectional view similar to FIG. 10, illustrating the pump in a subsequent phase of operation.

Referring now to FIGS. 9–11: FIGS. 9, 10 and 11 illustrate a piezoelectrically actuated peristaltic pump 260. A plurality of independently controllable piezoelectric actuator pairs 266, each actuator pair comprising curvilinear piezoelectric elements with concave surfaces facing each other, are arranged in series along a substantially flexible hose member 265. The opposite ends of the hose member 265 are provided with an inlet collar 263 and an outlet collar 268, having an inlet opening 270 and an outlet opening 271, respectively, as shown in the FIGS. 10 and 11. Check valves 264 may be provided in the inlet opening 270 or the outlet opening 271 to prevent back flow into the hose member 265. (In certain embodiments of the invention it may be desirable to reverse the flow of the pump 260, in which case check valves 264 are omitted.) A fluid supply 262 is connected to the pump inlet collar 263. Each of the piezoelectric actuator pairs 266 is electrically connected via electrical conductors 273 to a computer controlled electric power supply 272. The computer controlled electric power supply 272 produces electrical signals which it sends to the respective piezoelectric actuator pairs 266 through the electrical conductors 273. When an individual piezoelectric actuator pair 266 receives an appropriate electrical signal from the electric power supply 272 the actuator pair 266 constricts around the hose member 265, thus reducing the volume in the interior of the hose member 265 immediately adjacent the actuated actuator pair 266. When the electrical signal from the electric power supply 272 to an individual piezoelectric actuator pair 266 is reduced (or reversed), the actuator pair "opens" thus increasing the volume in the interior of the hose member 265 immediately adjacent the "open" actuator pair. Each actuator pair 266 may be fastened (for example by adhesive or similar means) to the exterior of the hose member 265 so that the hose member 265 is pulled "open" by the "opening" motion of an actuator pair 266. The various actuator pairs 266 may be held in fixed longitudinal relation to each other by a rigid frame member 269. The rigid frame member 269 is provided with opposing recesses 274 which are adapted to engage outboard flanges **266*a* of the actuator pairs 266. The flanges 266*a* are permitted to laterally move within the recesses 274 as the actuator pairs 266** radially expand and contract.

It will be understood that by controlling the amount of electrical stimulation of the individual piezoelectric actuator pairs 266, it is possible to control the volume in the interior of the hose member 265 immediately adjacent the respective actuator pairs. In the peristaltic pump 260 shown in FIGS. 9, 10 and 11 there are seven piezoelectric actuator pairs 266 which respectively control the immediately adjacent interior hose volumes in hose segments A,B,C,D,E,F and G. It will be understood that by controlling the sequencing of actuation of the various actuator pairs 266 (i.e. by controlling the electric signal output from the electric power supply) the hose member 265 segments (A,B,C,D,E,F and G) may be made to advantageously constrict and expand in a peristaltic wave form. The peristaltic constriction/expansion of the hose member 265 causes fluid to be "pumped" through device from the inlet towards the outlet. FIG. 10 and 11 show two sequential steps in the peristaltic operation of the pump. An arbitrary fluid volume, for example as indicated by arrow 267 at hose segment B in FIG. 10, pushed to the right by the coordinated constriction of hose segment A (as indicated by arrows 275) and expansion of hose segment C (as indicated by arrows 276). In FIG. 11 that same arbitrary fluid volume (indicated by arrow 267) has now moved to hose segment C, and is forced further to the right by the coordinated constriction of hose segment B (as indicated by arrows 277) and expansion of hose segment D (as indicted by arrows 278). It will be understood that in a similar fashion the motion (i.e. constriction and expansion) all of the actuator pairs 266 may be coordinated by the computer controlled electric power supply 272 so as to cause peristaltic pumping of the fluid from the inlet 270 to the outlet 271. It will also be understood that by controlling the sequencing of the actuation of the various actuator pairs 266, and/or by controlling the intensity of the electric signals (i.e. by computer control of the electric power supply output), it is possible to control the flow rate as well as the direction of flow of fluid through the pump 260.

Although FIGS. 9–11 show a peristaltic pump 260 having seven actuator pairs 266, it will be understood that any number of such actuator pairs 266 may be similarly used in accordance this invention. Also, although in the example given above, pairs of opposing piezoelectric elements are used to constrict/expand the interior volume of selected segments of the hose, it is within the scope of the present invention to alternatively use a series single annular piezoelectric actuators which radially constrict around the hose segments when energized, or to use other configurations or arrays of piezoelectric actuators to similarly effect the desired constriction/expansion of selected hose segments. Also, it is within the scope of this invention to provide a variation of the piezoelectrically actuated peristaltic pump wherein the single flexible hose member 265 if replaced with a series of independently deformable hose members arranged in series along an elongated conduit; and wherein check valves are disposed between adjacent hose members to prevent back flow between adjacent hose segments.

Figure 12:
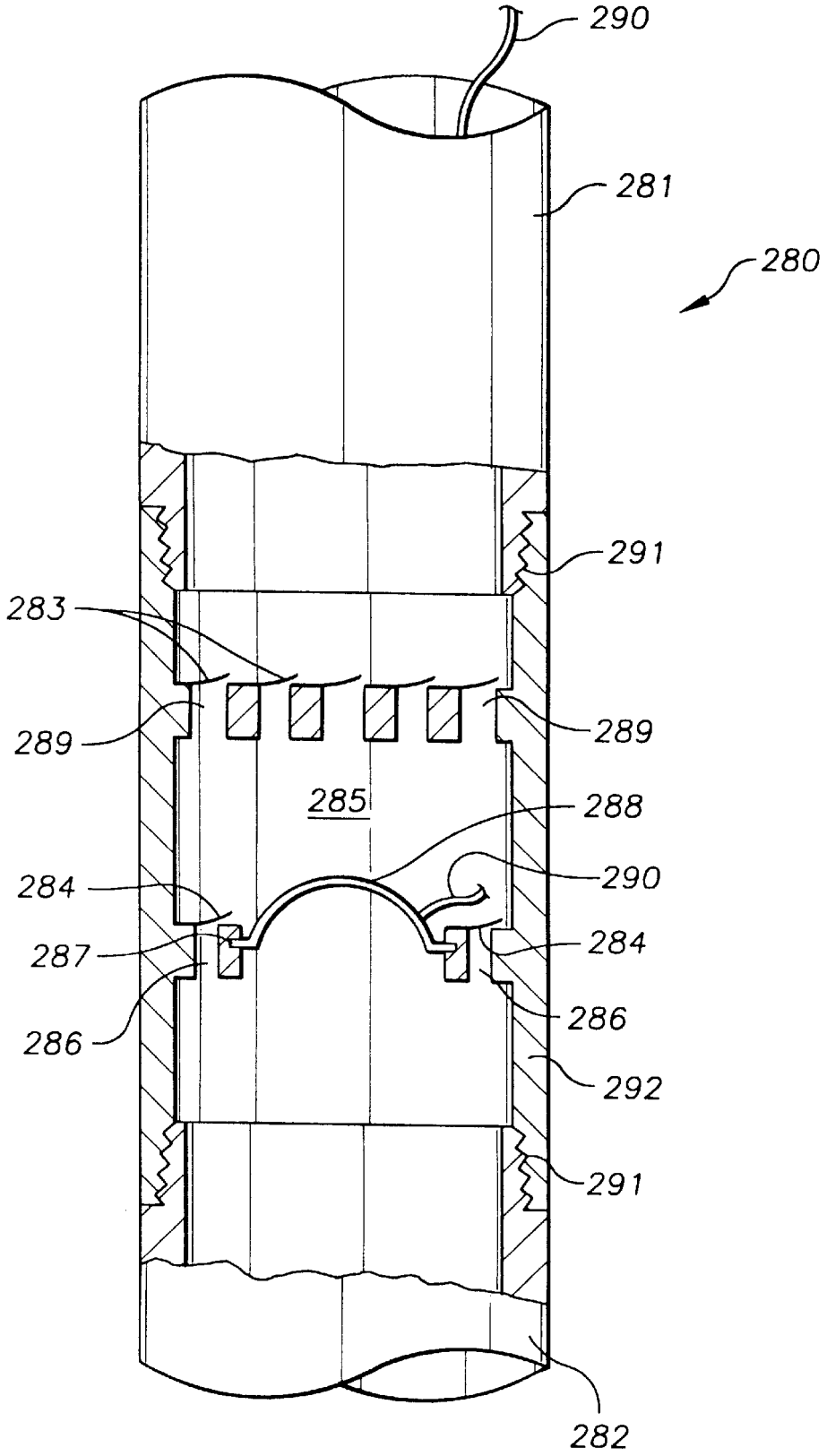
FIG. 12 is a medial cross-sectional view of a piezoelectrically actuated in-line pump.

Referring now to FIG. 12: FIG. 12 illustrates the construction of a piezoelectrically actuated in-line pump 280, such as may be used, for example, in a deep well. The pump 280 is secured in line between an upper pipe 281 and a lower pipe 282 by pipe threads 291 or other means. A piezoelectrically actuatable diaphragm member 288 is in electric communication (via conductor 290) with an electric power supply (not shown) which may be positioned remotely from the pump 280. Flapper-type check valves 283 are located adjacent each of one or more outlets 289 to prevent back flow into the pump chamber 285. Flapper-type check valves 284 are also located adjacent at each of one or more inlets 286 to prevent back flow out of the pump chamber 285. The working volume of the pump chamber 285 varies in accordance with the axial displacement of the piezoelectrically actuatable diaphragm member 288, the periphery of which is engaged in recesses 287 in the pump housing 292. When the piezoelectrically actuatable diaphragm member 288 is subjected to an electric field (i.e. via conductor 290) it axially deforms, thereby advantageously varying the pressure and volume inside the pump chamber, and, accordingly, pumping fluid from the lower pipe 282 to the upper pipe 281.

Figure 13:
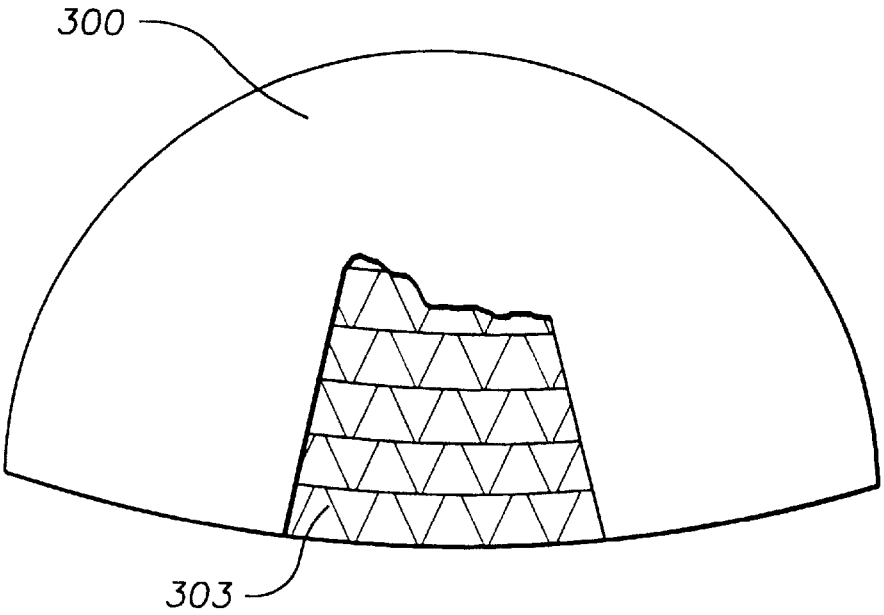
FIG. 13 is a perspective view illustrating a modified hemispheric diaphragm assembly.
Figure 14:
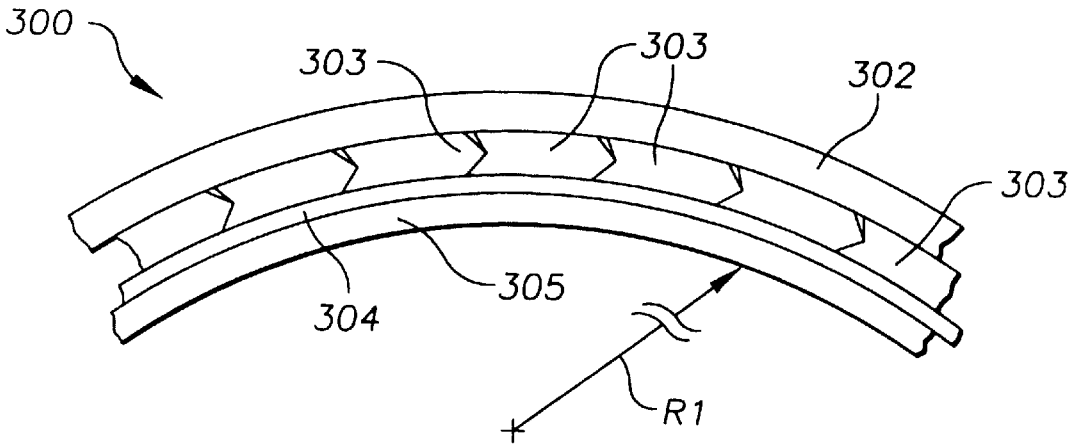
FIGS. 14, 15 and 16 are elevational views showing the details of construction of the modified hemispheric diaphragm assembly shown in FIG. 13.
Figure 15:
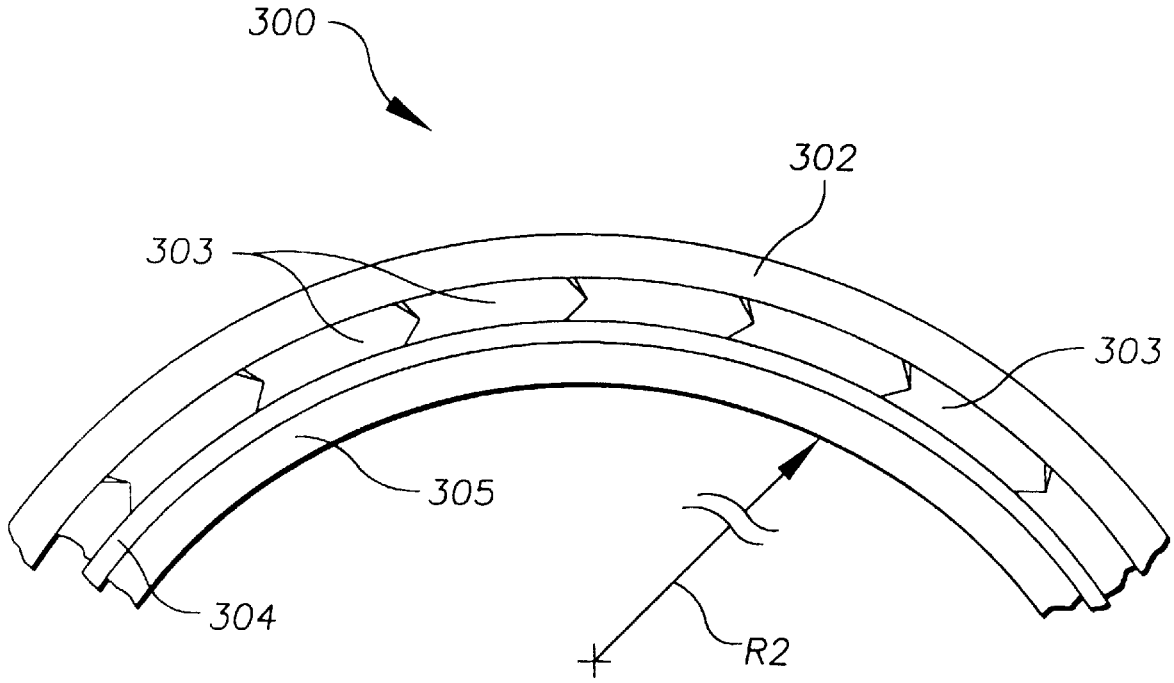
Figure 16:
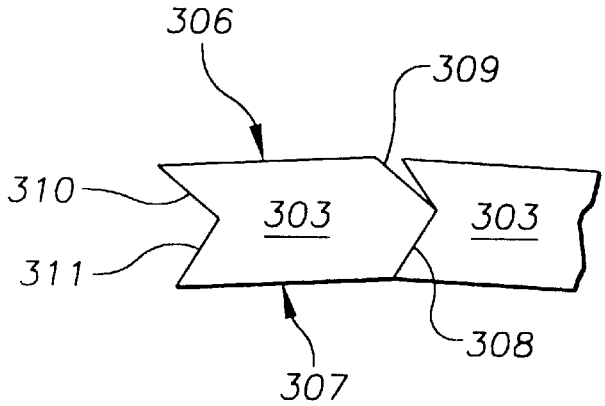

Referring now to FIGS. 13, 14, 15 and 16: FIG. 13 shows a modified hemispheric diaphragm member 300 which may be employed in any of the pump devices described hereinabove. The modified hemispheric diaphragm member 300 comprises a plurality of piezoelectric elements 303 (principally ceramics) which may be arranged in a geodesic hemispheric pattern (as shown in FIG. 13). The diaphragm member 300 comprises a continuous electrically conductive sheet 304 (such as aluminum foil) and a plurality of piezoelectric elements 303 positioned in a single layer, with an aft end plane 311 of each of said piezoelectric elements 303 being in physical contact with a forward end plane 308 of an adjacent piezoelectric element 303. Flexible, fluid-impermeable materials 302 and 305 (for example urethane rubber) may be provided adjacent the top surface 306 of the piezoelectric elements 303 and bottom surface of the electrically conductive sheet 304, respectively, to give form to the diaphragm member 300 and to render it water-tight. The bottom surface 307 of each piezoelectric element 303 is permanently attached to the electrically conductive sheet 304 by an adhesive (not shown). The aft surfaces 310 and 311 of each piezoelectric element 303 are shaped as shown in FIG. 16 (i.e. in a generally convex chevron configuration), and the forward surfaces 309 and 308 of each piezoelectric element 303 is shaped as shown in FIG. 16 (i.e. in a generally concave chevron configuration) so that the aft surface 311 closest to the electrically conductive material 304 maintains contact with the forward surface 308 closest to the electrically conductive material 304 of an adjacent piezoelectric element 303 whenever the radius of curvature R of the diaphragm changes. It will be understood by those skilled in the art that piezoelectric materials are typically (for example ceramics) fairly brittle, and when curvilinear piezoelectric elements made of such brittle materials are subjected to electric energy, they tend to bend and the convex surface (i.e. at the "outside" of the bend) may undergo sufficient tension to cause the piezoelectric material to fracture.

Figure 17:
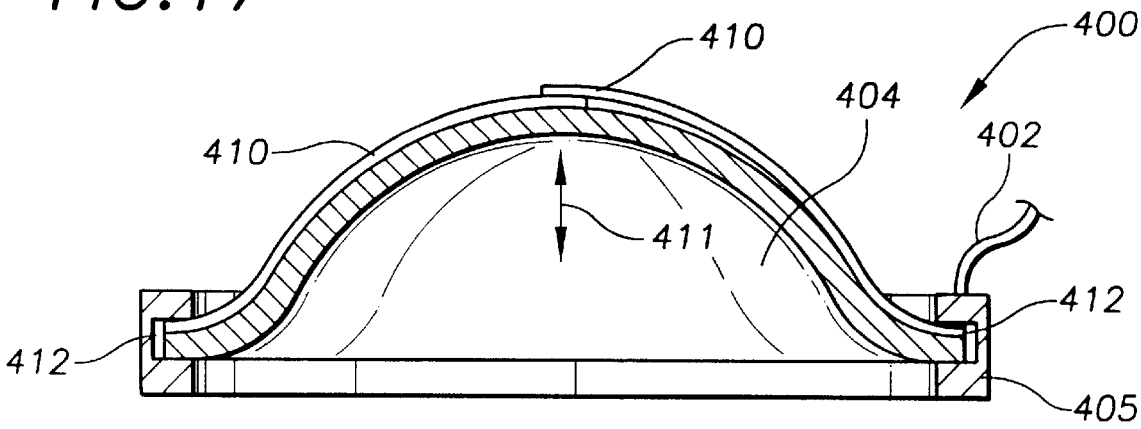
FIG. 17 is an elevational view showing a piezoelectrically actuated modified hemispheric diaphragm assembly.
Figure 18:
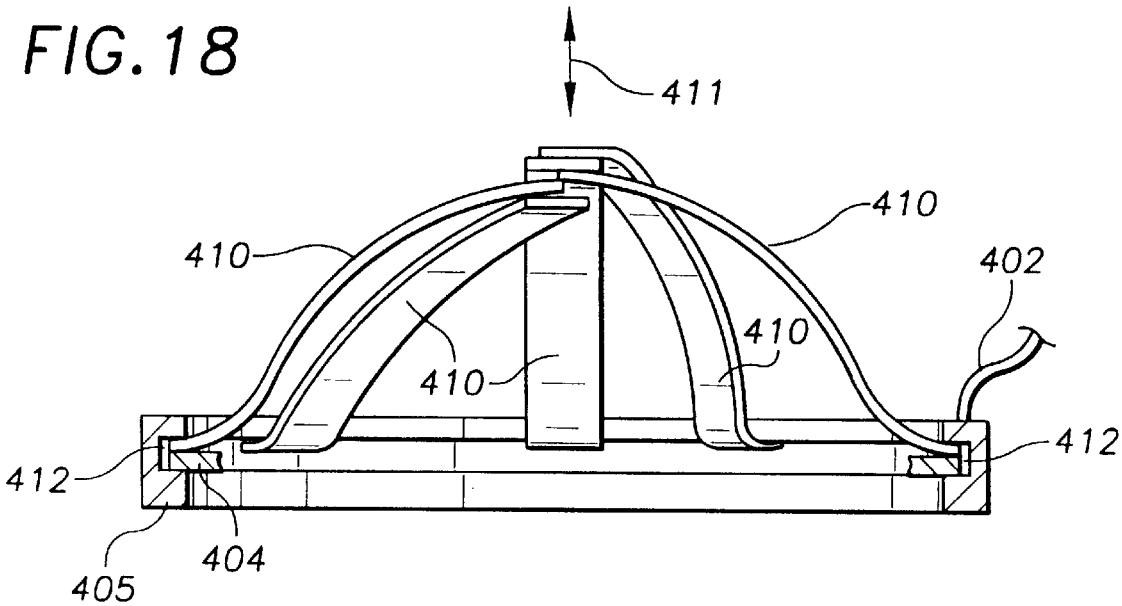
FIG. 18 is an elevational view showing the piezoelectrically actuated modified hemispheric diaphragm assembly of FIG. 17 with the flexible diaphragm material removed.

Referring now to FIGS. 17 and 18: FIG. 17 shows a modified hemispheric diaphragm assembly 400 which may be used with the above described pump devices. In the modified hemispheric diaphragm assembly 400, a plurality of cantilever-supported piezoelectric strips 410 are each fixedly attached at one end to a diaphragm frame 405. The various piezoelectric strips 410 each comprise piezoelectric elements which deform when subjected to an electrical field. The various piezoelectric strips 410 are each arcuately shaped and arranged so as to form a substantially hemispheric shape when assembled. The diaphragm frame 405 may be constructed of an electrically conductive material (eg. metal), to which is connected an electric power supply (not shown) via electric wire 402. A substantially hemispherically shaped flexible diaphragm member 404 is attached at its edge to the diaphragm frame 405, but is allowed to move within a recess 412 in the frame 405. When electric power is supplied to the frame, the current flows from the frame to each of the arcuately shaped piezoelectric strips 410, causing them to deform in concert, pressing against the flexible diaphragm member 404 and causing it to be axially displaced (as indicated at arrow 411).

Figure 19:
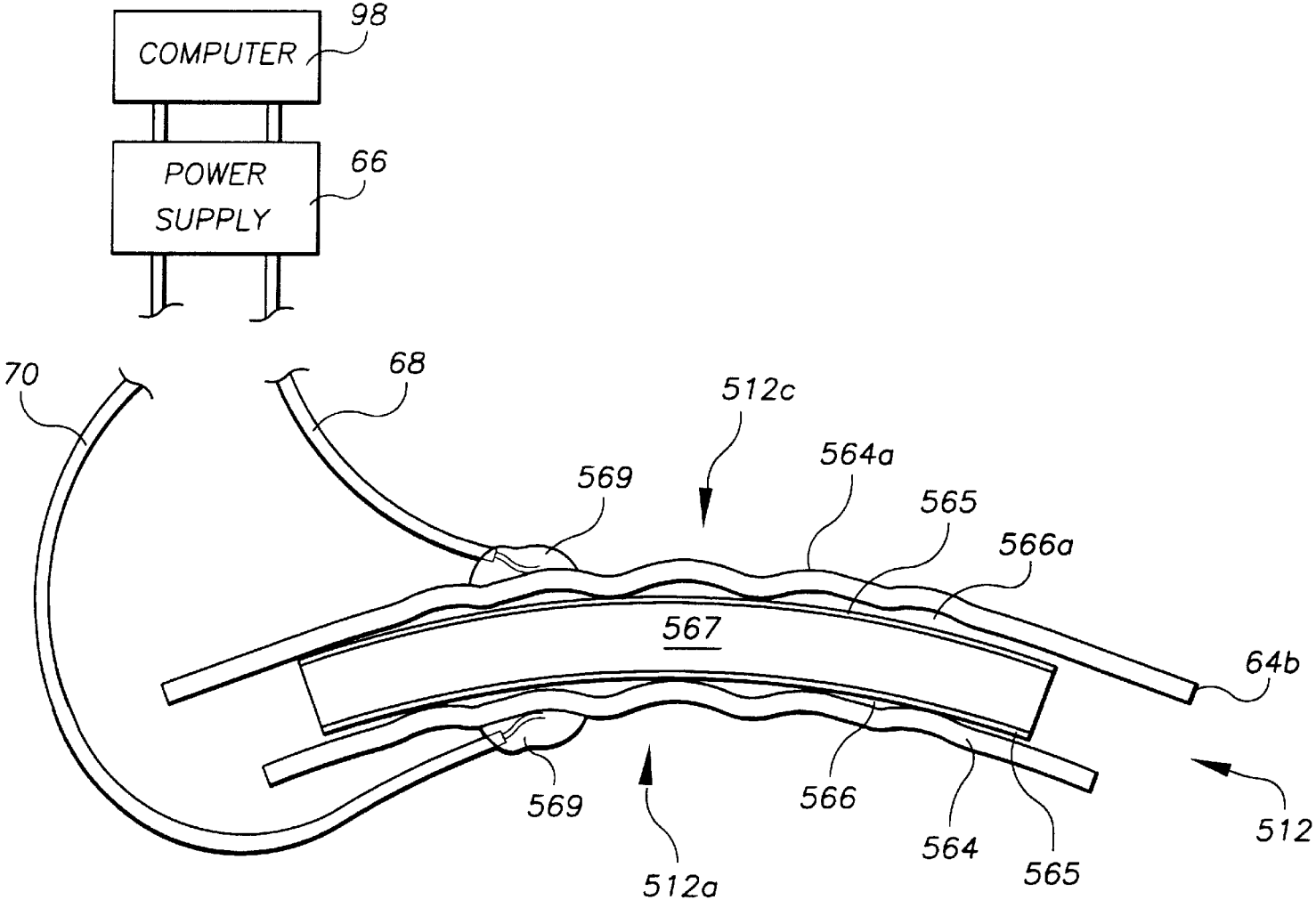
FIG. 19 is an elevational view showing the details of construction of a pre-stressed piezoelectric diaphragm member in accordance with a modification of the present invention.
Figure 20:
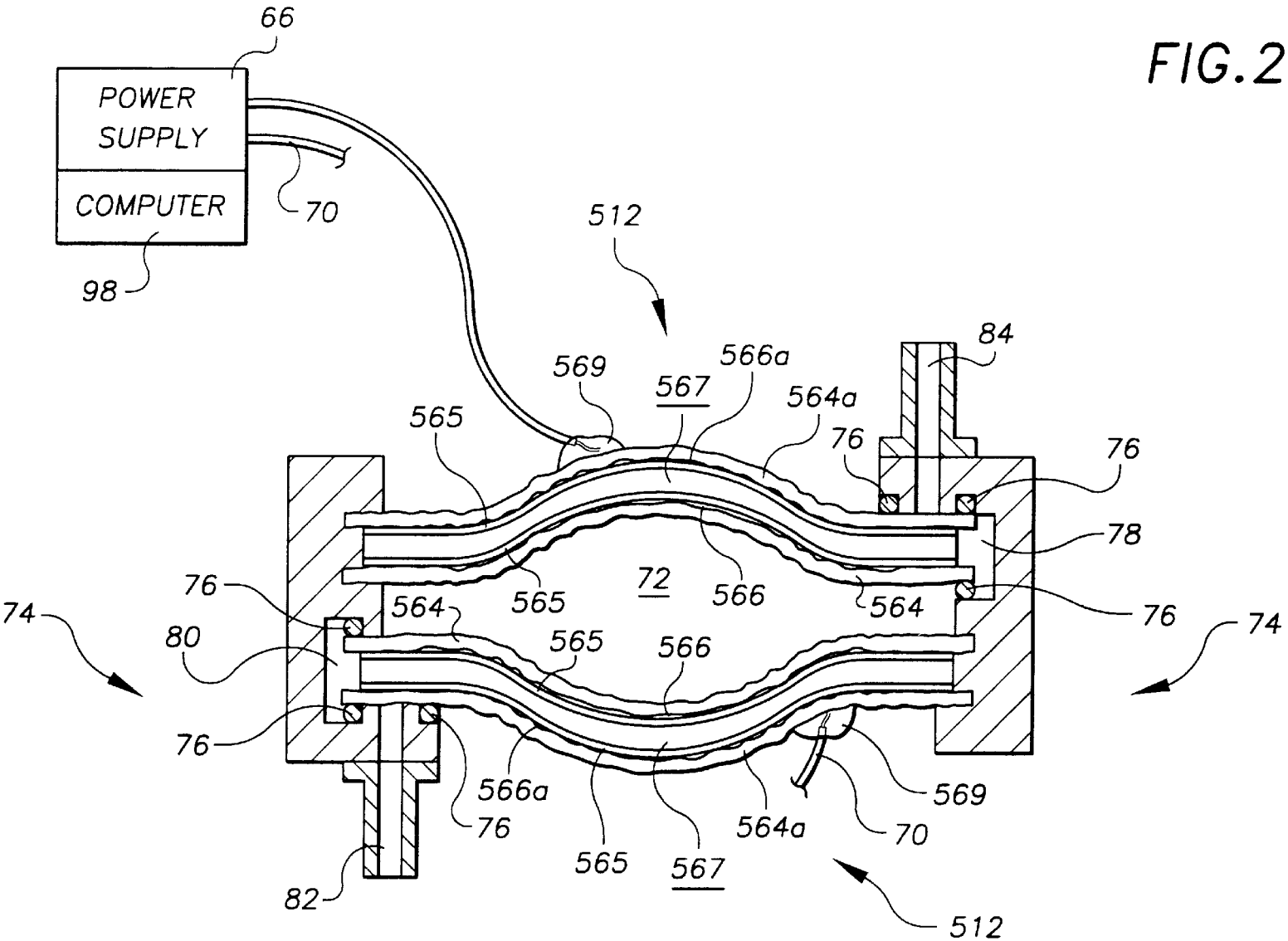
FIG. 20 is a medial cross-sectional elevation view showing a multiple-diaphragm pump having pre-stressed piezoelectric diaphragm members constructed in accordance with a modification of the present invention.

Referring now to FIGS. 19 and 20: In another modification of a dual-diaphragm pump, the diaphragm member(s) comprise flextensional piezoelectric actuators 512 as shown in FIGS. 19 and 20. Various constructions of flextensional piezoelectric actuators may be used (including, for example, "moonies", "rainbows", and other unimorph, bimorph, multimorph or monomorph devices, as disclosed in U.S. Pat. No. 5,471,721), but the actuators 512 are preferably Thermally Prestressed Piezoelectric ("TPP") actuators constructed in accordance with the following description.

Each TPP actuator 512 is a composite structure such as is illustrated in FIG. 19. Each TPP actuator 512 is preferably constructed with a PZT piezoelectric ceramic layer 567 which is electroplated 565 on its two major opposing faces. A steel, stainless steel, beryllium alloy or other metal first pre-stress layer 564 is adhered to the electroplated 565 surface on one side of the ceramic layer 567 by a first adhesive layer 566. The first adhesive layer 566 is preferably a soluble, thermoplastic copolyimide material such as described in U.S. Pat. No. 5,639,850. A second adhesive layer 566*a*, also preferably comprising a soluble, thermoplastic copolyimide material, is adhered to the opposite side of the ceramic layer 567. During manufacture of the TPP actuator 512 the ceramic layer 567, the adhesive layers 566 and 566*a* and the first pre-stress layer 564 are simultaneously heated to a temperature above the melting point of the adhesive material, and then subsequently allowed to cool, thereby re-solidifying and setting the adhesive layers 566 and 566*a*. During the cooling process the ceramic layer 567 becomes compressively stressed, due to the higher coefficient of thermal contraction of the material of the pre-stress layer 564 than for the material of the ceramic layer 567. Also, due to the greater thermal contraction of the laminate materials (e.g. the first pre-stress layer 564 and the first adhesive layer 566) on one side of the ceramic layer 567 relative to the thermal contraction of the laminate material(s) (e.g. the second adhesive layer 566*a*) on the other side of the ceramic layer 567, the ceramic layer deforms in an arcuate shape having a normally concave face 512*a* and a normally convex face 512*c,* as illustrated in FIG. 19. One or more additional pre-stressing layer(s) 564*a* may be similarly adhered to either or both sides of the ceramic layer 567 in order, for example, to increase the stress in the ceramic layer 567 or to strengthen the actuator 512.

Electrical energy may be introduced to the TPP actuator 512 from the electric power supply 66, which is in electrical communication with the computer 98, by the pair of electrical wires 68 and 70 attached to opposite sides of the TPP actuator 512 in communication with the electroplated 565 and 565*a* faces of the ceramic layer 567. As discussed above, the pre-stress layers 564 and 564*a* are preferably adhered to the ceramic layer 567 by the soluble, thermoplastic copolyimide material. The wires may be connected (for example by adhesive or solder 569) directly to the electroplated 565 and 565*a* faces of the ceramic layer 567, or they may alternatively be connected to the pre-stress layers 564 and 564*a*. In the preferred embodiment of the invention, the soluble, thermoplastic copolyimide material is a dielectric. When the wires 544 are connected to the pre-stress layers 564 and 564*a*, it is desirable to roughen a face of each pre-stress layer 564 and 564*a*, so that the pre-stress layers 564 and 564*a* intermittently penetrate the respective adhesive layers 566 and 566*a,* and make electrical contact with the respective electroplated 565 and 565*a* faces of the ceramic layer 567.

It will be appreciated by those skilled in the art that by using a diaphragm member comprising a pre-stressed piezoelectric element (e.g. TPP actuator 512) the strength, durability, and piezoelectric deformation (i.e. output) are each greater than would normally be available from a comparable piezoelectric element which is not pre-stressed. Accordingly, in this modified embodiment of the invention it is desirable to employ diaphragm members comprising pre-stressed piezoelectric ceramic layers 567; however, diaphragm members with non-pre-stressed piezoelectric ceramic layers may alternatively be used in modified embodiments of the present invention.

While the above description contains may specificities, these should not be construed as limitations on the scope of the invention, but rather as an exemplification of one preferred embodiment thereof. Many other variations are possible, for example:

The diaphragm member(s) may be oriented such that the dome portion is normally convex with respect to the pump chamber 18;

The adhesive layer(s) may comprise any adhesive that advantageously bonds the various layers of the TPP actuator 12 together, such as LaRC™-IA material or LaRC™-SI material, which were each developed by NASA-Langley Research Center and are commercially marketed by IMITEC, Inc. of Schenectady, N.Y., or other thermoplastics, epoxies or the like.

In a modification of the present invention wherein the piezoelectric ceramic layer is pre-stressed, the adhesive layer alone may act as the pre-stress layer.

In a modification of the present invention wherein the piezoelectric ceramic layer is pre-stressed, the ceramic layer may have only one pre-stress layer bonded to one of its major faces to provide the desired amount of pre-stressing.

In a suction pump constructed in accordance with the present invention wherein the discharge pressure is suitably low, the outlet check valve (32) may be omitted;

The electrical conductor(s) between the electric power supply 14 and the diaphragm member(s) may be in any common form, including buses, wires, and printed circuits, and the point of attachment of the conductor(s) to the diaphragm member(s) may be at any location on the diaphragm member;

A pump constructed in accordance with the present invention may provide means for advantageous variation of the voltage, current or frequency applied to the diaphragm member(s).

In a multi-diaphragm pump constructed in accordance with the present invention the voltage applied to individual diaphragm members may be different from the voltage simultaneously applied to the other diaphragm member(s).

In a multi-diaphragm pump constructed in accordance with the present invention the current applied to individual diaphragm members may be different from the current simultaneously applied to the other diaphragm member(s).

In a multi-diaphragm pump constructed in accordance with the present invention the frequency applied to individual diaphragm members may be different from the frequency simultaneously applied to the other diaphragm member(s).

The computer (42) may comprise a pre-programmed micro-chip attached directly to the pump housing or to the diaphragm member, or it may be physically remote from the pump housing;

The frequencies of the electrical signals to be sent to the diaphragm members may be manually adjusted or may be computer controlled;

Multiple-diaphragm pump devices may be constructed having any number of diaphragm members;

In a multiple-diaphragm pump device having numerous diaphragm members, the diaphragm members may be the same size or different sizes;

In a multiple-diaphragm pump device having numerous diaphragm members, the frequency of oscillation of each diaphragm member may be individually regulated so that the combined effect of the motions of the plurality of diaphragm members produces the desired pressure-volume performance characteristics, and so that coordinated adjustment of the frequencies of oscillations of the various diaphragm members correspondingly adjusts the pressure-volume discharge performance of the device;

The computer may be in communication with one or more sensors which sense a physical condition of the pumped fluid, (for example, hydraulic pressure or flow rate), and, in response to the sensed condition, vary the frequency of the electrical signal to the diaphragm member(s) so as to correspondingly vary the sensed condition;

Control of influent and effluent fluid into and out of the pump chamber may be controlled by check valves (28 and 32) or other means for opening and closing the inlet and outlet in the described sequence;

In a diaphragm pump device in which one or more sensors which sense a physical condition of the pumped fluid is in communication with a computer (14) which regulates the frequency of oscillation of a diaphragm member, the sensing element may be a piezoelectric valve, which piezoelectric valve may be opened and closed in response to electrical signals sent to it by a computer-regulated electric power supply, and which piezoelectric valve may send electrical signals to the computer indicative of the hydraulic pressure of the pumped fluid; and In a diaphragm pump device in which both the diaphragm member(s) and the inlet or outlet flow control valves (28 or 32) comprise each comprise piezoelectric elements, the motion of each of said components may be coordinated by a computer responsive to feedback signals sent to the computer by any or all of the piezoelectric components;

The pump chamber may be manifolded such that a plurality of inlets simultaneously communicate with a single pump chamber;

The electric power supply may comprise a photovoltaic element such that the pump may be driven by solar power.

Accordingly, the scope of the invention should be determined not by the embodiment illustrated, but by the appended claims and their legal equivalents.

We claim:

1. A pump, comprising:

a pump housing surrounding a pump housing interior;

a first deformable member, said first deformable member being disposed within said pump housing interior;

wherein said first deformable member comprises a first piezoelectric layer, said first piezoelectric layer having opposing first and second major faces;

wherein said first deformable member further comprises a first pre-stress layer, said first pre-stress layer being bonded to said first major face of said first piezoelectric layer;

wherein said first pre-stress layer normally applies a compressive force to said first piezoelectric layer;

wherein said first deformable member partially encloses a variable volume pump chamber;

and wherein said pump housing partially encloses said variable volume pump chamber;

a second deformable member, said second deformable member being disposed within said pump housing interior;

wherein said second deformable member comprises a second piezoelectric layer, said second piezoelectric layer having opposing first and second major faces;

wherein said second deformable member further comprises a second pre-stress layer, said second pre-stress layer being bonded to said first major face of said second piezoelectric layer;

wherein said second pre-stress layer normally applies a compressive force to said second piezoelectric layer;

and wherein said second deformable member partially encloses said variable volume pump chamber;

a first port in said pump housing communicating said variable volume pump chamber with the exterior of said pump housing;

a second port in said pump housing communicating said variable volume pump chamber with the exterior of said pump housing;

valving means in communication with said first port for temporarily opening and closing said first port;

and energizing means in communication with said first piezoelectric layer and said second piezoelectric layer for electrically energizing said first piezoelectric layer and said second piezoelectric layer;

wherein said energizing means comprises means for applying a first alternating voltage difference at a first frequency between said first major face of said first piezoelectric layer and said second major face of said first piezoelectric layer;

and wherein said energizing means further comprises means for applying a second alternating voltage difference at a second frequency between said first major face of said second piezoelectric layer and said second major face of said second piezoelectric layer.

2. The apparatus according to claim 1, wherein said first frequency and said second frequency are the same.

3. The apparatus according to claim 2, further comprising means for controlling a phase angle difference between said first alternating voltage and said second alternating voltage.

4. The apparatus according to claim 3, wherein said means for controlling said phase angle difference between said first alternating voltage and said second alternating voltage further comprises means for varying said phase angle difference from 0 degrees to 180 degrees.

5. The apparatus according to claim 1, wherein said energizing means further comprises means for applying a third alternating voltage difference at a third frequency between said first major face of said first piezoelectric layer and said second major face of said first piezoelectric layer;

wherein said energizing means comprises means for applying a fourth alternating voltage difference at a fourth frequency between said first major face of said second piezoelectric layer and said second major face of said second piezoelectric layer;

wherein said energizing means further comprises means for varying an alternating voltage difference between said first major face of said first piezoelectric layer and said second major face of said first piezoelectric layer from said first alternating voltage difference to said third alternating voltage difference;

wherein said energizing means further comprises means for varying an alternating voltage difference between said first major face of said second piezoelectric layer and said second major face of said second piezoelectric layer from said second alternating voltage difference to said fourth alternating voltage difference.

6. The apparatus according to claim 5, further comprising means for varying a frequency of said alternating voltage difference between said first major face of said first piezoelectric layer and said second major face of said first piezoelectric layer from said first frequency to said third frequency;

and further comprising means for varying a frequency of said alternating voltage difference between said first major face of said second piezoelectric layer and said second major face of said second piezoelectric layer from said second frequency to said fourth frequency.

7. The apparatus according to claim 6, wherein said first frequency and said third frequency are unequal;

and wherein said second frequency and said fourth frequency are unequal.

8. The apparatus according to claim 7, wherein said first major face of said first piezoelectric layer has a first area;

wherein said first major face of said second piezoelectric layer has a second area;

and wherein said first area is larger than said second area.

9. The apparatus according to claim 1, wherein said first pre-stress layer comprises a polyimide;

and wherein said second pre-stress layer comprises a polyimide.

* * * * *